US007597176B2

(12) United States Patent
Zaharia

(10) Patent No.: US 7,597,176 B2
(45) Date of Patent: Oct. 6, 2009

(54) ELEVATOR CAR POSITION DETERMINING SYSTEM AND METHOD USING A SIGNAL FILLING TECHNIQUE

(75) Inventor: Vlad Zaharia, Rocky Hill, CT (US)

(73) Assignee: Otis Elevator Company, Farmington, CT (US)

( * ) Notice: Subject to any disclaimer, the term of this patent is extended or adjusted under 35 U.S.C. 154(b) by 366 days.

(21) Appl. No.: 11/659,688

(22) PCT Filed: Aug. 10, 2004

(86) PCT No.: PCT/US2004/026234

§ 371 (c)(1),
(2), (4) Date: Feb. 6, 2007

(87) PCT Pub. No.: WO2006/022710

PCT Pub. Date: Mar. 2, 2006

(65) Prior Publication Data

US 2007/0227831 A1 Oct. 4, 2007

(51) Int. Cl.
*B66B 3/02* (2006.01)

(52) U.S. Cl. ..... 187/394; 324/207.12; 73/1.79

(58) Field of Classification Search ..... 187/391–394, 187/413, 414, 247; 324/207.11–207.16, 324/207.2, 207.22, 207.24, 245, 171, 176, 324/178; 73/1.79, 1.81
See application file for complete search history.

(56) References Cited

U.S. PATENT DOCUMENTS

| | | | | |
|---|---|---|---|---|
| 4,387,436 | A * | 6/1983 | Katayama et al. | 702/94 |
| 4,389,631 | A * | 6/1983 | Kajiyama et al. | 187/394 |
| 4,427,095 | A * | 1/1984 | Payne et al. | 187/394 |
| 5,085,294 | A * | 2/1992 | Iwata | 187/394 |
| 5,509,505 | A | 4/1996 | Steger et al. | |
| 5,821,477 | A | 10/1998 | Gerstenkorn | |
| 5,889,239 | A | 3/1999 | Blackaby et al. | |
| 6,386,327 | B2 * | 5/2002 | Lacarte Estallo | 187/394 |
| 6,435,315 | B1 | 8/2002 | Zaharia | |
| 6,874,244 | B2 * | 4/2005 | Birrer et al. | 33/708 |
| 6,886,667 | B2 * | 5/2005 | Kunz et al. | 187/394 |
| 7,493,991 | B2 * | 2/2009 | Oh et al. | 187/394 |

* cited by examiner

*Primary Examiner*—Jonathan Salata
(74) *Attorney, Agent, or Firm*—Bachman & LaPointe, P.C.

(57) ABSTRACT

A method for determining a position of a moving object, such as an elevator car in an elevator shaft, includes the steps of mounting a leading sensor and a lagging sensor to the moving object and spacing the leading sensor from the lagging sensor by an offset distance, mounting a plurality of spaced apart position indicators along a pathway of the moving object, transmitting signals representative of object position from the leading sensor and the lagging sensor to a controller as the sensors pass the spaced apart position indicators, and filling any gaps in the signal gathered from one of the sensors by using a correction factor established from the position sensed by the other sensor and the offset distance. A system for performing the method is described.

17 Claims, 4 Drawing Sheets

ELEVATOR CAR POSITION DETERMINING SYSTEM AND METHOD USING A SIGNAL FILLING TECHNIQUE

BACKGROUND OF THE INVENTION (1) Field of the Invention

The present invention relates to a system and a method for determining the position of a moving object and more specifically to a system and a method for determining the position of an elevator car.

(2) Prior Art

A technique, known as the PVT position approximation technique, has been widely used in industry to determine the position of elevator cars. The PVT technique uses machine encoder information, also known as the primary velocity transducer or PVT, corrected to vanes mounted at fixed locations in the hoistway. Determining car position in express zones presents a particular challenge since a PVT-based approximation system may have errors due to rope stretch, slip, etc. The car position may be corrected upon detection of a door zone vane at the end of the express zone; however, the longer the express zone the more difficult it is to blend in the PVT-based position feedback with the vane-based position feedback. In order to provide a smoother transition, additional vanes have been mounted in the express zone, thus increasing the installed cost.

Elevator safety codes require that traction elevators be provided with terminal stopping devices, such as a normal terminal stopping device (NTSD), an emergency terminal speed limiting device (ETSLD), an emergency terminal stopping device (ETSD), and final terminal stopping devices. ETSLD is used on elevators with reduced stroke buffer, while ETSD is used on elevators with full stroke buffer. These devices use car position and speed information near the top and bottom of the hoistway to (1) bring the car to a controlled slowdown and stop at or near the terminal landing (NTSD), or (2) generate an emergency stop by removing power from the driving machine and brake (ETSD and ETSLD and final terminal stopping devices).

Codes also require independence between the normal control system, NTSD, and ETSD, as summarized below. Operation of ETSLD must be entirely independent of the operation of NTSD. The car speed sensing device for ETSLD must be independent of the normal speed control system. ETSD must function independent of the NTSD and of the normal speed control system.

The main disadvantage of current systems is the relatively high installed cost resulting from the multitude of sensors and vanes, mounted on different tracks (for NTSD, ETSD and door zones) and an additional channel on machine speed encoder.

SUMMARY OF THE INVENTION

Accordingly, it is an object of the present invention to provide an improved elevator car position determining system and method.

The foregoing objects are attained by the elevator car position determining system and method of the present invention.

In accordance with the present invention, a method for determining a position of a moving object, such as an elevator car in an elevator shaft, includes the steps of mounting a leading sensor and a lagging sensor to the moving object and spacing the leading sensor from the lagging sensor by an offset distance, mounting a plurality of spaced apart position indicators along a pathway of the moving object, transmitting signals representative of object position from the leading sensor and the lagging sensor as the sensors pass the spaced apart position indicators to a controller, and filling any gaps in the signal gathered from one of the sensors by using a correction factor established from the position sensed by the other sensor and the offset distance.

Further in accordance with the present invention, a position determination system for a moving object comprises a leading sensor and a lagging sensor mounted to the moving object with the leading sensor being spaced from the lagging sensor by an offset distance. The system further includes a plurality of spaced apart position indicators along a pathway of the moving object, means for receiving signals representative of a position of the moving object from the leading sensor and the lagging sensor as the sensors pass the spaced apart position indicators, and means for filling any gaps in the signal gathered from one of the sensors by using a correction factor established from the position detected from the other sensor and the offset distance. Another aspect of the present invention is that the system may include means for filling the gaps in signals gathered by the two sensors, by using a correction factor derived from a PVT signal.

Other details of the elevator car position determining system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
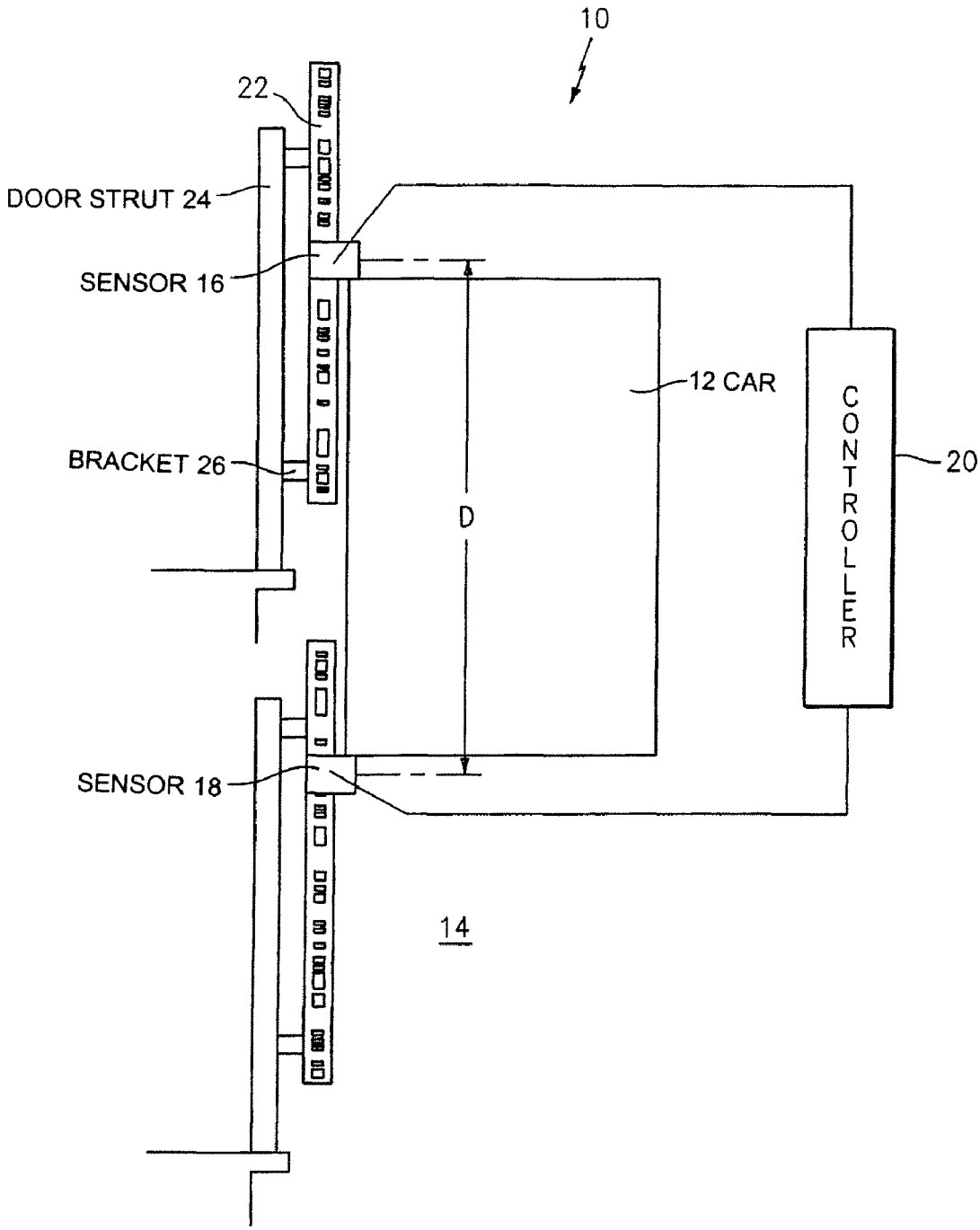
FIG. 1 is a schematic representation of an elevator car position determining system in accordance with the present invention.

Referring now to the drawings, FIG. 1 illustrates an elevator car position determining system 10. The system 10 includes an elevator car 12 which moves in an elevator hoistway 14. The car 12 has a first sensor 16 mounted on top of the car and a second sensor 18 mounted at the bottom of the car. The sensors 16 and 18 are offset from each other by a distance D. Depending on the movement of the car 12, one of the sensors 16 and 18 will be the leading sensor (the first sensor in the direction of movement) and the other will be the lagging sensor (the second sensor in the direction of movement). While the sensors 16 and 18 have been described as being mounted to the top and the bottom of the car, they could be located in other positions if desired, provided that they are aligned and offset from each other.

Each of the sensors 16 and 18 communicates with a controller 20. The controller 20 may be any suitable processor known in the art.

Figure 6:
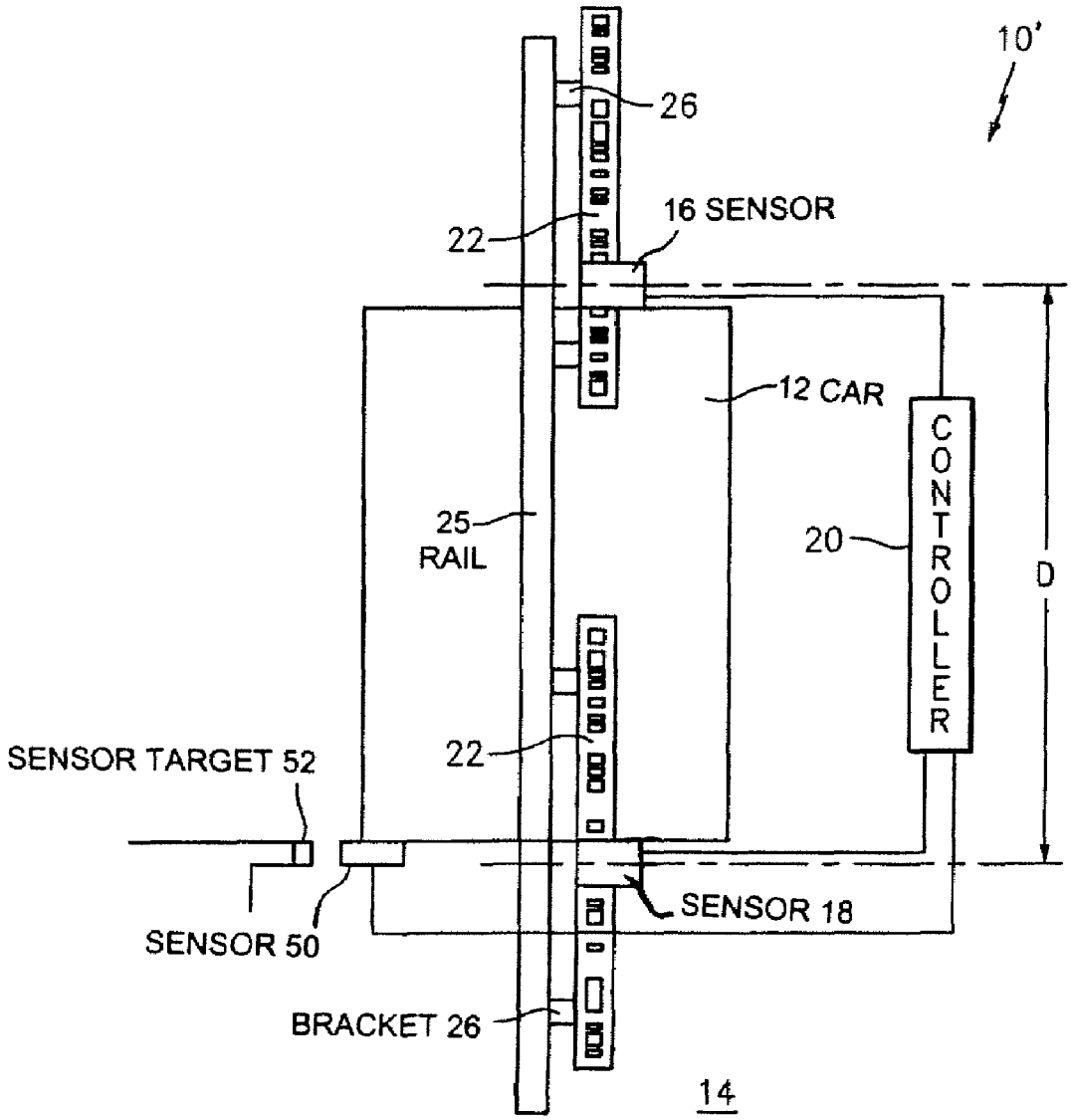
FIG. 6 illustrates an alternative embodiment of an elevator car position determining system.

The system 10 also includes a plurality of spaced apart position indicators 22. Each position indicator 22 may be mounted to a landing door strut 24 or door sills by a plurality of mounting brackets 26 if desired. One advantage to mounting the position indicators to landing door struts or to door sills is that the position of the indicators 22 would change with building settlement, thus always providing a true indication of the position of the landing. Alternatively, the position indicators 22 may be mounted on guide rails 25 for the elevator car, as shown in FIG 6.

The position indicators 22 may comprise any suitable position indicators or smart vanes known in the art. For example, the position indicators 22 may consist of discrete sections of encoded perforated tape. In such a case, the sensors 16 and 18 may comprise optical sensors that translate perforated patterns in the indicators 22 into unique absolute positions.

Alternatively, position indicators 22 may consist of smart vanes such as code rail sections with each individual section being located at one of the landings. Each code rail section may contain a series of indicia markers spaced by a desired distance, such as 0.25 m apart. The code rail sections may each be separated by a gap distance which is less than the distance D between the sensors 16 and 18. In a system employing such code rail sections, the sensors 16 and 18 may each be a camera. The code rail sections may be encoded with numerals, each of which indicates a position within the hoistway. The numbers may represent any value that will enable the elevator control to determine the exact car position within the hoistway in a unique, non-repetitive manner. The controller 20 may be programmed in any suitable manner known in the art to take the information received from the sensors 16 and 18 and to generate an elevator car position signal. A position reference system using code rail sections such as that described herein is shown in U.S. Pat. No. 6,435,315, which is incorporated by reference herein.

Alternatively, the position indicators 22 may be smart vanes formed by a plurality of spaced apart magnetic strips with each strip having an absolute position track and an incremental position track. The absolute position track on each strip may comprise a plurality of magnets of different sizes arranged in a single, unique, non-repeatable pattern. For example, there may be alternating small and large magnets formed into different patterns. The incremental position track on each strip may comprise a plurality of equally spaced apart magnets. The sensors 16 and 18 in such a system may be magnetic sensors having their output supplied to the controller 20. Each sensor 16 and 18 may comprise any suitable array of magnetoresistive and/or Hall effect sensors known in the art, such as a magnetoresistive sensor manufactured by Siko GmbH, for detecting and measuring the strength of the magnetic fields generated by the magnets forming the patterns in the absolute position track and the magnets forming the incremental position sensor track. As before, the position indicators 22 are spaced apart a distance less than the distance D between the sensors 16 and 18. In operation, each sensor 16 and 18 detects the unique magnetic field signature of a particular pattern of the absolute position track. In this way, the controller knows the position of the car within the hoistway. The sensors also detect the magnetic field generated by the magnets forming the incremental position track and from this can determine the speed of the elevator car.

If desired, a system 10' in accordance with the present invention may have the magnetic strip, smart vane, position indicators 22 described above mounted to a guide rail 34 instead of the landing door struts or door sills. When mounted in such a location, the position indicators 22 no longer track building settlement. Therefore, as shown in FIG. 6, a third sensor 50 may be mounted on the car 12 and a sensor target 52 may be mounted rigidly at each landing. The output of the third sensor 50 may be supplied to the controller 20.

Figure 2:
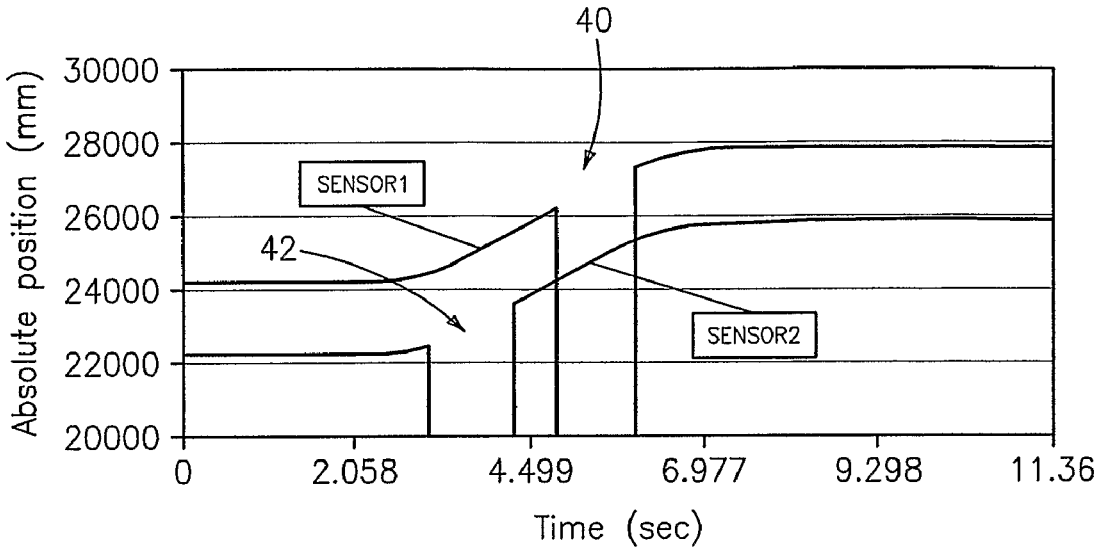
FIG. 2 illustrates the sensor feedback for a dual sensor configuration with at least one sensor reading elevator car position information at any time.

In a first embodiment of the present invention, the two sensors 16 and 18 are mounted in-line on the car 12. Smart vane position indicators 22 are mounted as shown in FIG. 1. The sensors 16 and 18 and the position indicators 22 are arranged such that at least one sensor reads a section of at least one position indicator at any time. FIG. 2 illustrates the position feedback from each sensor 16 and 18 as it is supplied to the controller 20. As can be seen from FIG. 2, as the leading sensor (Sensor 1) transitions from one position indicator 22 to the next, there is no position feedback signal transmitted from the sensor when it is in the gap between position indicators 22. However, position feedback is being provided by the lagging sensor (Sensor 2), which is still reading a position indicator. Similarly, as the lagging sensor (sensor 2) transitions from one position indicator 22 to the next, there is no position feedback signal transmitted from the sensor when it is in the gap between position indicators 22. However, position feedback is being provided by the leading sensor (Sensor 1) which is still reading a position indicator.

Figure 3:
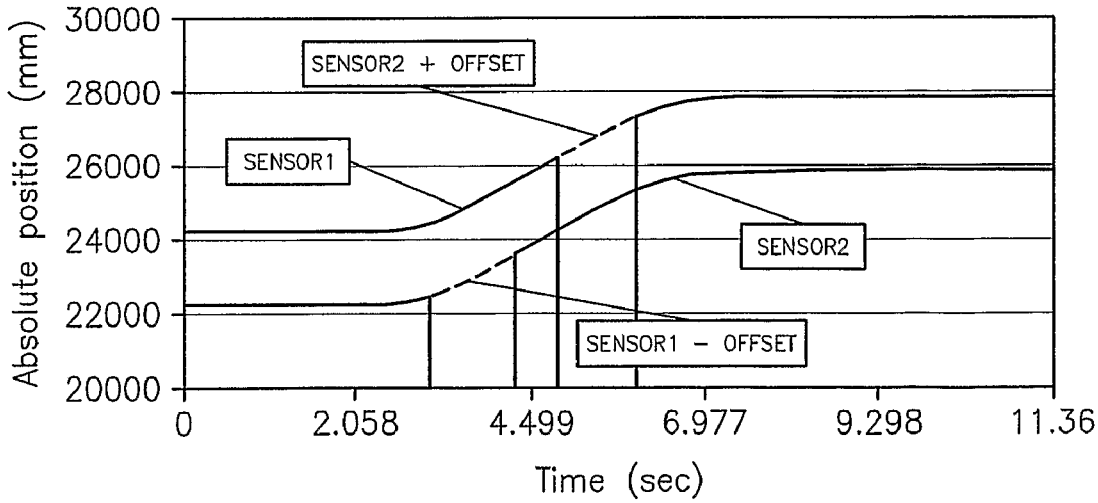
FIG. 3 illustrates the sensor feedback of FIG. 2 with a synthesized position in the gap(s)

As shown in FIG. 3, the controller 20 is programmed to fill in the gap portions 40 and 42 in the Sensor 1 and Sensor 2 signals. This is done in the case of the Sensor 1 signal and the gap 40 by applying a correction factor which is the position feedback signal from Sensor 2 plus the offset distance. In the case of gap 42 in the Sensor 2 signal, this is done by applying a correction factor which is the position feedback signal from Sensor 1 and subtracting the offset distance. The controller 20 may be programmed using any suitable algorithm to be a means for gathering the signals from the sensors 16 and 18 and a means for filling the gaps in the position signals gathered from the sensors 16 and 18.

As a result of the method and system employed herewith, absolute hoistway position of the elevator car 12 can be determined at any point in time.

In an alternative embodiment of the present invention, two sensors 16 and 18 are mounted in-line on the elevator car 12 as discussed above. In this case however, the position indicators 22 are only mounted at landings and not in express zones. The position indicators 22 in such an arrangement may be shorter, thus providing installed cost savings.

In this embodiment, at various positions in the hoistway, both sensors 16 and 18 would be off the position indicators and thus incapable of providing position signals to the controller 20. The controller 20 may thus be programmed to approximate the position of each sensor during the period of time when there are no signals and hence the position of the car using a PVT (primary velocity transducer) feedback technique. In this technique, an optical encoder is used. The optical encoder typically produces 1024 pulses/revolution. The controller 20 counts the pulses and approximates the distance traveled and from that the position of the elevator car 12 in the hoistway. This is shown in FIGS. 4 and 5 with the PVT correction factors being shown in the dotted lines.

Figure 4:
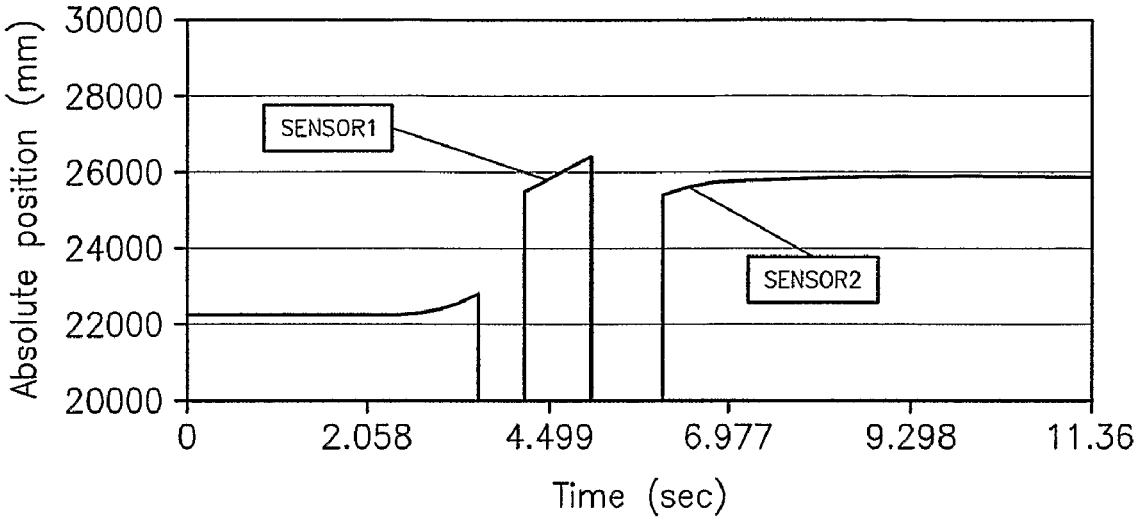
FIG. 4 illustrates the sensor feedback for an alternative embodiment of a dual sensor configuration.
Figure 5:
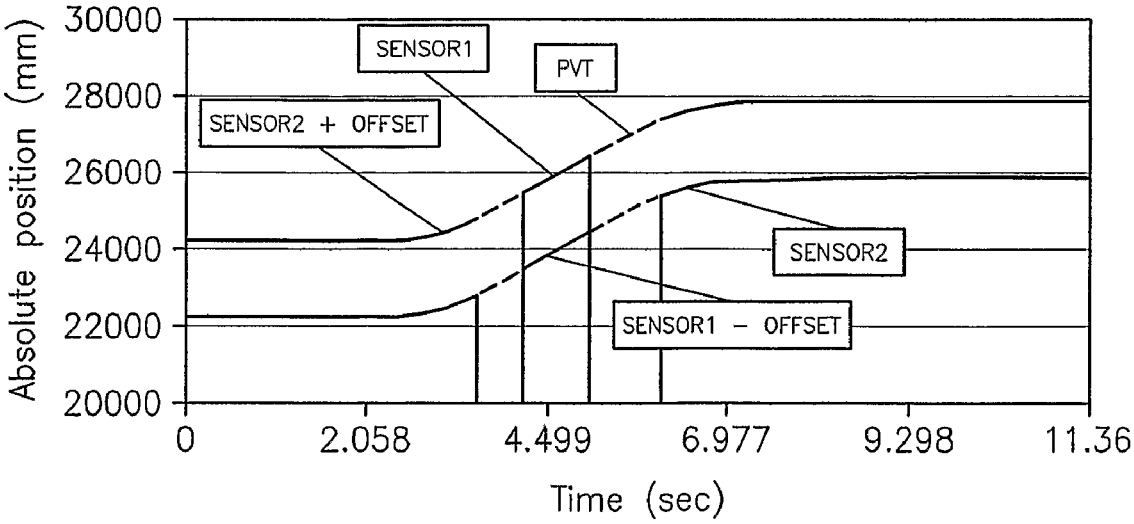
FIG. 5 illustrates the sensor feedback of FIG. 4 with a synthesis position in the gap(s)

Referring now to FIGS. 4 and 5, and assuming that the car is traveling in an UP direction, because of their placement on the car 12, sensor 16 (Sensor 1) leads sensor 18 (Sensor 2) with respect to hoistway position and the direction of travel. At the beginning of the run, the lagging sensor (Sensor 2) is assigned as the primary means for position control. As the car begins its motion, the lagging sensor (Sensor 2) leaves the position indicator 22 and for a while, when both sensors are off vanes, the car position is approximated by the controller 20 using the PVT feedback technique described above. As the car approaches the destination floor, the leading sensor (Sensor 1) starts to read the position indicator at that floor. At this point, where the Sensor 2 is farther than Sensor 1 from the destination floor (by a distance equal to the distance between the two sensors 16 and 18), a first position correction is performed by the controller 20. The first position correction is the application of a correction factor which is based on the difference between the position feedback signal generated by the leading sensor (Sensor 1) and the position feedback derived from the PVT. The controller 20 performs a second position correction when the lagging sensor (Sensor 2), which is the primary means for position control, begins to read the position indicator at the destination floor. The second position correction is the application of a correction factor which is based on the difference between the position feedback signal generated by the lagging sensor (Sensor 2) and the position feedback derived from the PVT.

This approach takes advantage of the spacing between the two sensors 16 and 18 to perform two position corrections. The leading sensor performs the role of a position look ahead device, allowing an early position correction, while the lagging sensor is used for the second position correction and leveling into the floor. This approach also allows a smoother transition between the PVT-based car approximation and the position indicator or smart vane based car position. This eliminates the need for additional vanes in the hoistway.

The systems shown herein may be used to implement NTSD and ETSD/ETSLD functions. This is because the sensors 16 and 18 provide all necessary information for implementing NTSD and ETSD/ETSLD functions. In the embodiments shown in FIGS. 2-5, the sensor 16 may be used for NTSD, while the sensor 18 may be used for ETSD, regardless of the direction of travel. Preferably, the length of the encoded rail section (smart vane) in a terminal landing zone is such that both sensors 16 and 18 can read the encoded rail section at the same time, when the elevator car is in that zone. In such a case, NTSD may be performed using the position generated by the sensor 16 and the speed derived from the sensor 16 position information; and ETSD may be performed using the sensor 18 and the speed derived from sensor 18 position information. The speed information for NTSD and ETSD may be derived by the controller 20. Table I summarizes the main difference between the existing and proposed implementations.

TABLE I

| | Normal position and speed control | NTSD | ETSD/ETSLD |
|---|---|---|---|
| Existing | Position: Machine encoder (Channels A & B) + door zone sensors + door zone vanes Speed: Machine encoder (Channels A & B) | Position: NTSD sensors + NTSD vanes Speed: Machine encoder (Channels A & B) | Position: ETSD/ETSLD sensors + ETSD/ETSLD vanes Speed: Machine encoder (Channel C) |
| Proposed (using common smart vanes) | Position: Sensor 2 Speed: Machine encoder (Channels A & B) | Position: Sensor 1 Speed: Sensor 1 | Position: Sensor 2 Speed: Sensor 2 |

Also, in the embodiments shown in FIGS. 2-5, the sensors associated with NTSD and ETSD functions alternate, depending on the direction of travel (e.g. the leading sensor is used for NTSD, while the lagging sensor is used for ETSD). Thus, position information for the NTSD function may be determined from the sensor 16 or 18 depending on the direction of travel and speed can be derived from the position information generated by sensor 16 or sensor 18. The position information for the ETSD function may be determined from sensor 16 or 18, depending on the direction of travel, speed can be derived from the position information generated by sensor 16 or 18. The speed derivations for the NTSD and ETSD may be performed by the controller 20.

The position determination methods shown herein have numerous benefits including: significant installed cost savings; dual sensor redundancy which eliminates the need for separate devices for NTSD, ETSD, and independent speed check; the elimination of correction runs, in cases such as loss of absolute position due to momentary loss of building power; automatic floor table adjustment when excessive building settlement is detected; and smoother transition of position feedback from PVT-based car position to the position indicator absolute position.

While the position determination system of the present invention has been described in the context of an elevator system moving through a hoistway, the position determination system could be used in other environments to determine the position of a wide variety of moving objects. For example, the moving object could be a vehicle such as a train car which travels along a pathway.

It is apparent that there has been provided in accordance with the present invention an elevator car position determining system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for determining a position of a moving object comprising the steps of:

mounting a leading sensor and a lagging sensor to said moving object and spacing said leading sensor from said lagging sensor by an offset distance;

mounting a plurality of spaced apart position indicators along a pathway of said moving object;

transmitting signals representative of object position from said leading sensor and said lagging sensor to a controller as said sensors pass said spaced apart position indicators; and filling any gaps in said signal gathered from one of said sensors by using a correction factor established from said position sensed by said other sensor and said offset distance.

2. A method according to claim 1, wherein said filling step comprises filling any gap in said signal gathered by said leading sensor with said position sensed by said lagging sensor plus the offset distance.

3. A method according to claim 1, wherein said filling step comprises filling any gap in said signal gathered by said lagging sensor with said position sensed by said leading sensor minus the offset distance.

4. A method according to claim 1, wherein said mounting step comprises mounting said sensors to an elevator car and said indicator step comprises mounting a plurality of spaced apart smart vanes at spaced apart landings.

5. A method according to claim 4, wherein said signal transmitting step comprises transmitting the signal from said lagging sensor as a primary position control signal and said filling step comprises determining car position based on PVT feedback when both of said sensors are not sensing one of said smart vanes.

6. A method according to claim 5, wherein said filling step further comprises performing a first position correction when said leading sensor starts to read a vane at a destination floor and performing a second position correction when the lagging sensor begins to read the vane at said destination floor.

7. A method according to claim 6, wherein said first position correction comprises applying a correction factor based on the difference between the position feedback signal generated by said leading sensor and a position feedback derived from said PVT and wherein said second position correction comprises applying a correction factor which is based on the difference between the position feedback signal generated by the lagging sensor and the position feedback derived from the PVT.

8. A method according to claim 1, wherein said indicator mounting step comprises mounting a plurality of smart vanes on guide rails.

9. A method according to claim 1, wherein said indicator mounting step comprises mounting said position indicators to a plurality of door sills to track building settlement.

10. A method for determining a position of a moving object comprising the steps of:

mounting a leading sensor and a lagging sensor to said moving object and spacing said leading sensor from said lagging sensor by an offset distance;

mounting a plurality of spaced apart position indicators along a pathway of said moving object;

transmitting signals representative of object position from said leading sensor and said lagging sensor to a controller as said sensors pass said spaced apart position indicators; filling any gaps in said signal gathered from one of said sensors by using a correction factor established from said position sensed by said other sensor and said offset distance; and using said object position representative signal from said leading sensor and a speed signal derived from said leading sensor object position representative signal for performing NTSD and using said object position representative signal from said lagging sensor and a speed signal derived from said lagging sensor object position representative signal for performing ETSD.

11. A method according to claim 10, further comprising alternating said sensors as said leading and lagging sensors as a function of direction of travel.

12. A position determination system for a moving object comprising:

a leading sensor and a lagging sensor mounted to said moving object, said leading sensor being spaced from said lagging sensor by an offset distance;

a plurality of spaced apart position indicators along a pathway of said moving object;

means for receiving signals representative of a position of said moving object from said leading sensor and said lagging sensor as said sensors pass said spaced apart position indicators; and means for filling any gaps in said signal gathered from one of said sensors by using a correction factor established from said position detected from said other sensor and said offset distance.

13. A system according to claim 12, wherein said filling means comprises means for filling any gap in said signal gathered by said leading sensor with said position sensed by said lagging sensor plus the offset distance and means for filling any gap in said signal gathered by said lagging sensor with said position sensed by said leading sensor minus the offset distance.

14. A system according to claim 12, wherein said moving object is an elevator car and said indicators comprise a plurality of spaced apart smart vanes mounted at spaced apart landings.

15. A position determination system for a moving object comprising:

a leading sensor and a lagging sensor mounted to said moving object, said leading sensor being spaced from said lagging sensor by an offset distance;

a plurality of spaced apart position indicators along a pathway of said moving object;

means for receiving signals representative of a position of said moving object from said leading sensor and said lagging sensor as said sensors pass said spaced apart position indicators;

means for filling any gaps in said signal gathered from one of said sensors by using a correction factor established from said position detected from said other sensor and said offset distance;

said indicators comprising a plurality of spaced apart smart vanes mounted at spaced apart landings; and said signal gathering means comprising means for using the signal from said lagging sensor as a primary position control signal and said filling means comprises means for determining car position based on PVT feedback when both of said sensors are not sensing one of said smart vanes.

16. A system according to claim 15, wherein said filling means further comprises means for performing a first position correction when said leading sensor starts to read a vane at a destination floor and means for performing a second position correction when the lagging sensor begins to read the vane at said destination floor.

17. A system according to claim 16, wherein said first position correction performing means comprises means for applying a correction factor which is based on the difference between the position feedback signal generated by the leading sensor and the position feedback derived from the PVT and wherein said second position correction performing means comprises means for applying a correction factor which is based on the difference between the position feedback signal generated by the lagging sensor and the position feedback derived from the PVT.

* * * * *